US007204727B2

(12) United States Patent
Germani

(10) Patent No.: US 7,204,727 B2
(45) Date of Patent: Apr. 17, 2007

(54) ELECTRICAL CONNECTOR ELEMENT WITH REWIRABLE SPRING CONTACTS

(75) Inventor: Emilio Germani, Legnano (IT)

(73) Assignee: Industria Lombarda Materiale Elettrico I.L.M.E. S.p.A., Milan (IT)

( * ) Notice: Subject to any disclaimer, the term of this patent is extended or adjusted under 35 U.S.C. 154(b) by 0 days.

(21) Appl. No.: 11/367,385

(22) Filed: Mar. 6, 2006

(65) Prior Publication Data

US 2006/0199444 A1 Sep. 7, 2006

(30) Foreign Application Priority Data

Mar. 7, 2005 (IT) ..... MI20050072 U

(51) Int. Cl.
*H01R 4/48* (2006.01)

(52) U.S. Cl. ..... 439/835; 439/106; 439/222

(58) Field of Classification Search ..... 439/835, 439/106, 222

See application file for complete search history.

(56) References Cited

U.S. PATENT DOCUMENTS 6,010,347 A * 1/2000 Lee ..... 439/222
6,283,801 B1 * 9/2001 Guinda et al. ..... 439/835
6,786,779 B2 * 9/2004 Feldmeier et al. ..... 439/729

* cited by examiner

*Primary Examiner*—Truc Nguyen
(74) *Attorney, Agent, or Firm*—Young & Thompson

(57) ABSTRACT

A standard type electrical connector element (1; 100; 200; 300), with a square cross-section measuring about 21×21 mm, includes (2; 102; 202; 302) within which are formed seats (22) adapted to house contacts (4; 204) adapted to receive the conductors (50) of electrical feed cables; a seat (23) adapted to house a contact (6; 106; 206; 306) adapted to go into contact with the conductor of an electrical earth cable, a cover (8; 108) which can be coupled on the body and which is provided with holes (83, 82) disposed in register with the contacts (4; 204) to allow the conductors of the feed and earth cables to be inserted, and spring elements (7) disposed in the seats (22, 23) of the body in which the contacts are housed to clamp the conductors of the electrical cables in contact with the respective contacts.

20 Claims, 4 Drawing Sheets

ELECTRICAL CONNECTOR ELEMENT WITH REWIRABLE SPRING CONTACTS

BACKGROUND OF THE INVENTION

The present invention refers to an electrical connector element with rewirable contacts, wherein the feed cable conductors can be inserted removably into the terminals of the connector element.

In the field of connectors for industrial environments various market standards have become consolidated over time in terms of size, number of poles and rated voltages. Amongst these there are connectors measuring 21 mm×21 mm, with 3 or 4 poles plus an earth contact, for currents of 10 A and a rated voltage of 250V. These connectors are provided with plastic or metal cases, are produced by numerous manufacturers and are generally mechanically and electrically interconnectable with each other.

A research is currently under way among manufacturers to put onto the market connectors that are able to work with increasingly high rated voltages, though maintaining the same dimensions as the connectors of the standard type used until now and being interconnectable therewith.

The connector elements of the prior art with rewirable contacts, because of the above mentioned industry standard, have insulation piercing terminals or screw terminals.

The connector elements with screw terminals have a body of insulating plastic material. A first seat is formed in the body to house the part of the terminal that must accommodate the conductor of the feed cable and a second seat to house the screw to be screwed into the terminal to clamp the conductor therein.

The conductors can be inserted axially from the top of the body, and the clamping screws can work transversally from one side of the body of the connector element. In this case the heads of the screws remain very close to the walls of the metal case, which surrounds the body of the connector element.

Alternatively, the conductors can be inserted transversally from one side of the body of the connector element and bent upwards at 90° and the clamping screws can be inserted axially from the top of the body. In this case it is the conductors of the feed cables that are near to the inner walls of the metal case.

In both cases, the distance between the head of the clamping screw, or the conductor of the feed cable, and the wall of the metal case is sufficient to ensure electrical insulation for connectors used at rated voltages of 250 V, but it is not sufficient to ensure the minimum safety distance required by current international safety standards for connectors used at rated voltages of 400 V.

This drawback is solved at least in part by utility model DE 2001 5602 U, in which a standard type plug-and-socket connector measuring 21×21 mm that can be used for rated voltages of 400 V has been designed. In this plug-and-socket connector the conductors are clamped to the terminals by means of screws. In this case, in order to eliminate the risks due to the small distance between the heads of the screws and the walls of the metal case, an additional element has been introduced in the form of an insulating plastic hood that encloses the live parts of the contacts, shielding them from the metal walls of the case.

The hood can be moved into two locking positions: top and bottom. When the hood is in the top position, the cables can be connected to the screw terminals of the contacts; subsequently it is necessary to push the hood downwards to shield the screw heads from the walls of the case.

This solution is rather complex and costly, because of the provision of an additional element to be inserted into very limited spaces.

SUMMARY OF THE INVENTION

The object of the present invention is to eliminate the drawbacks of the prior art by providing an electrical connector element with rewirable conductors, maintaining the size of standard connector elements, which is interconnectable therewith and at the same time can also be used with very high rated voltages.

Another object of the present invention is to provide an electrical connector element with rewirable conductors which ensures an efficient, effective and safe conductor clamping system which at the same time is cheap, easy to produce and easy to assemble.

The electrical connector element according to the invention is of the standard type with a square cross-section measuring about 21×21 mm and is adapted to couple with a complementary electrical connector element. The electrical connector element comprises a body within which are formed:

- seats adapted to accommodate respective contacts adapted to receive respective conductors of electrical feed cables, and
- a seat adapted to house a contact adapted to come into contact with a conductor of an electrical earth cable.

The connector element further comprises a cover that can be coupled on the body and is provided with holes disposed in register with the contacts to allow the conductors of the feed and earth cables to be inserted.

The main feature of the present invention is represented by the fact that the connector element uses spring contacts, disposed in the seats of the body, to clamp the conductors of the electrical cables.

In this manner the springs, even if they are of conducting metal material, remain insulated inside the seats of the contacts and the connector element can be used for high rated voltages, up to 400 volts.

BRIEF DESCRIPTION OF THE DRAWINGS

Further characteristics of the invention will be made clearer by the detailed description that follows, referring to purely exemplary and therefore non-limiting embodiments thereof, illustrated in the appended drawings, in which.

DESCRIPTION OF THE PREFERRED EMBODIMENTS

Figure 1:
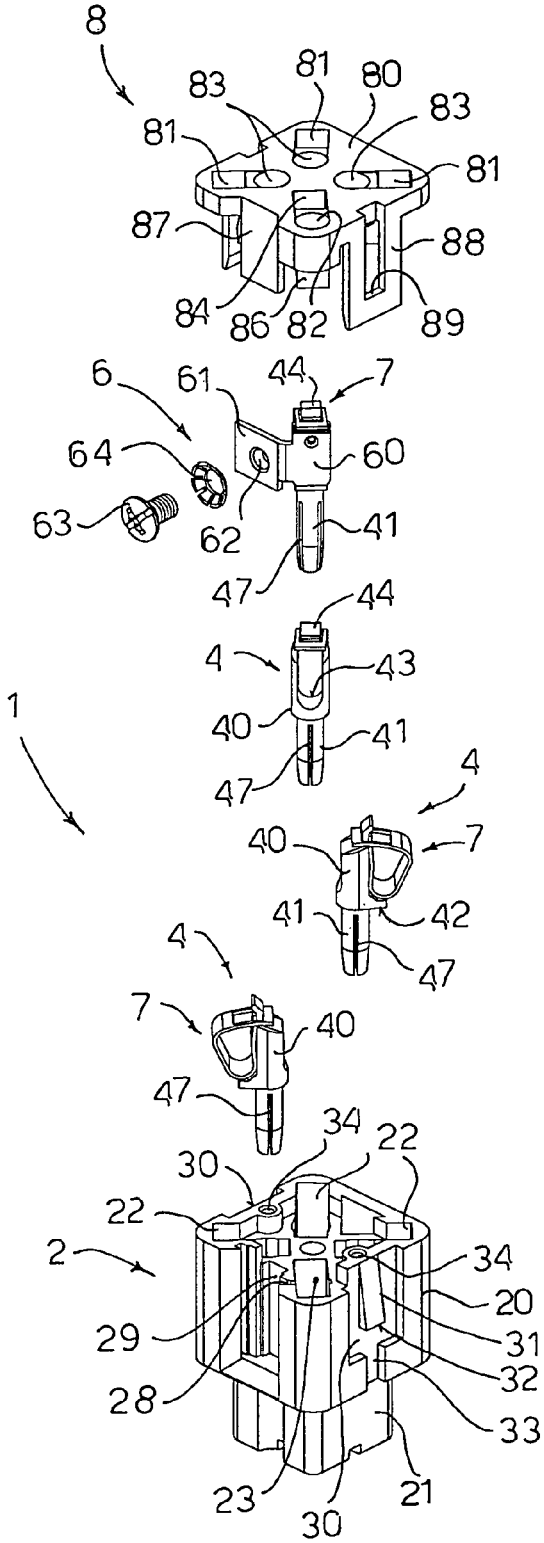
FIG. 1 is an exploded view illustrating a first embodiment of a connector element with three female pole contacts and an earth contact.

With reference to FIG. 1, a connector element according to the invention, denoted as whole with reference numeral 1, is illustrated. The connector element comprises a body 2 having a standard, substantially parallelepiped shape, with a substantially square cross section measuring 21×21 mm.

Figure 5:
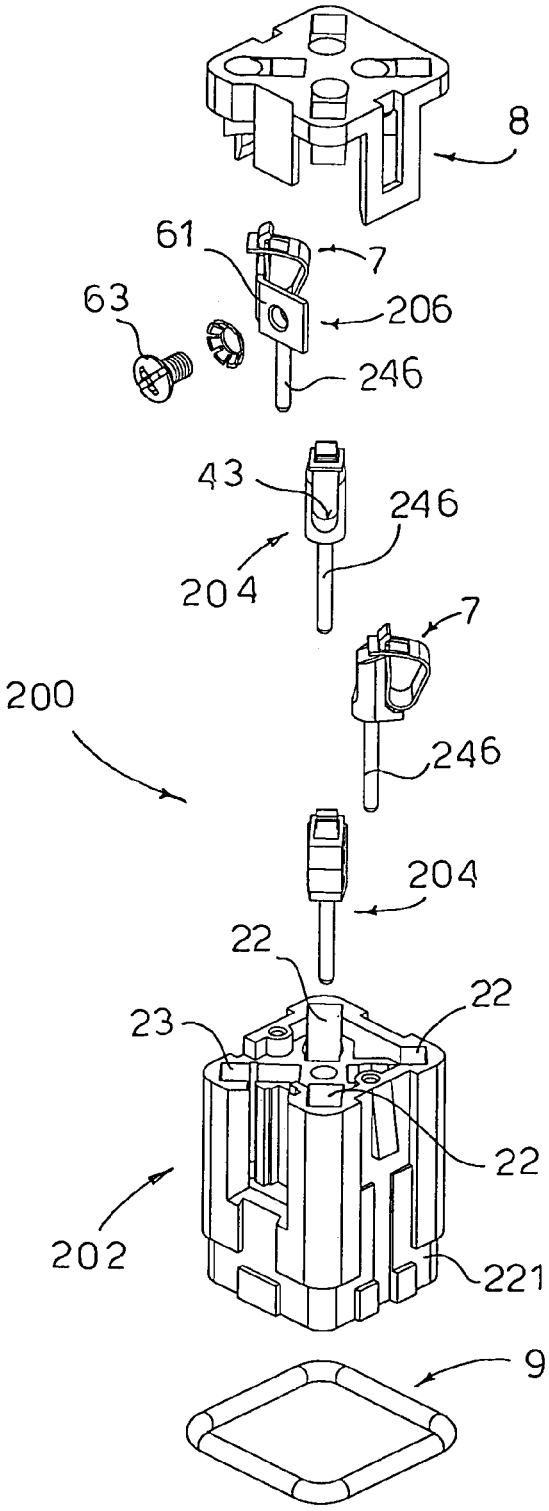
FIG. 5 is an exploded view like FIG. 1 of a connector element with three male pole contacts and an earth contact.

The body 2 has a top part 20 and a bottom part 21, smaller in size than the top part. The bottom part 21 represents the coupling part with the respective coupling part of a complementary connecting element 200 (FIG. 5).

In the body 2 there are formed three seats 22 to house respective contacts 4 of the poles and a seat 23 to receive an earth contact 6. The four seats 22, 23 of the contacts are disposed in pairs along the two diagonals of the body 2.

Figure 2:
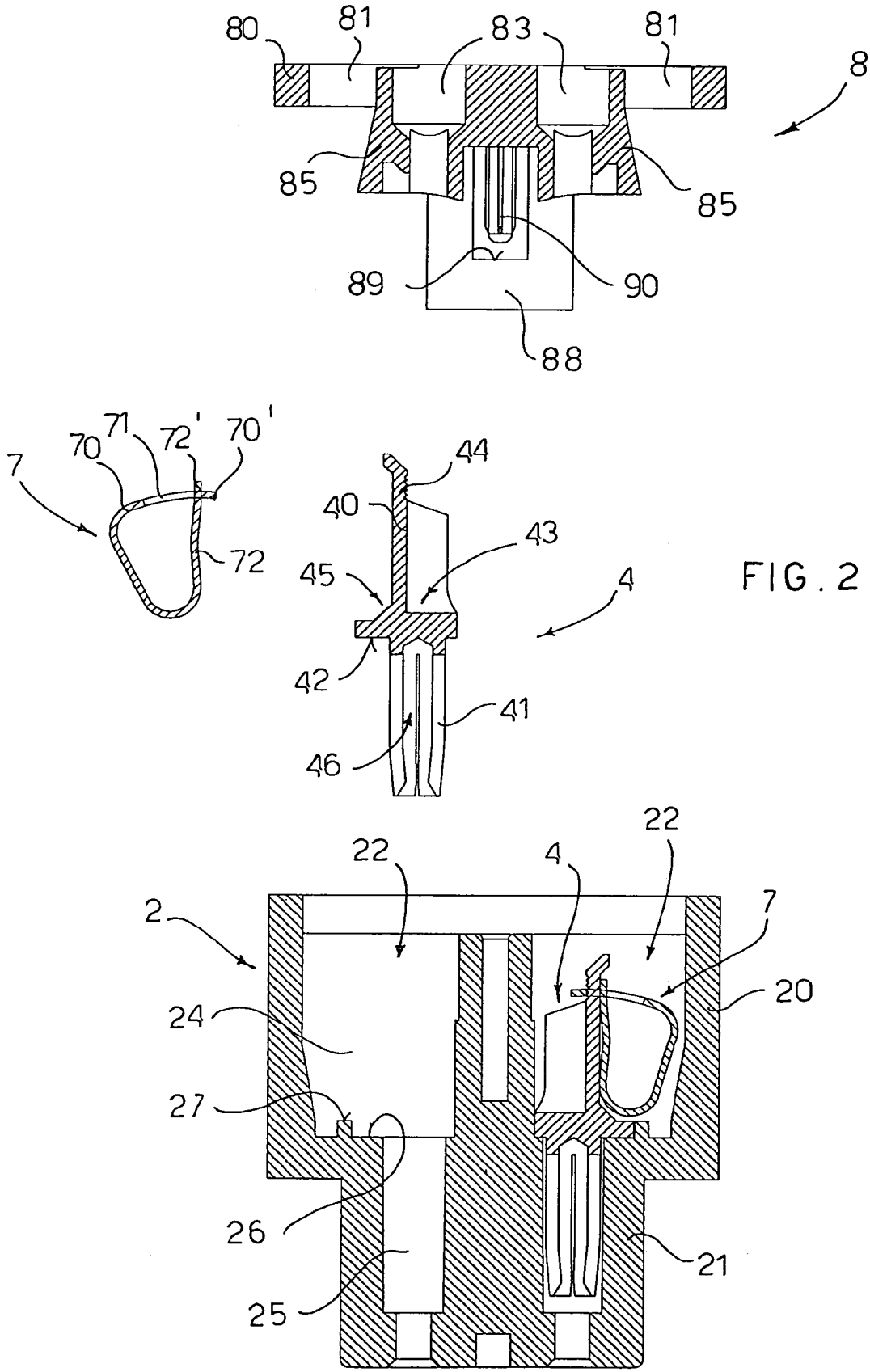
FIG. 2 is a view illustrating a conductor connected to a feed cable and, in an exploded view, a body and a cover for the connector element of FIG. 1 in axial section taken along a diagonal thereof and a single contact in axial section with the sectioned spring thereof exploded.

As shown better in FIG. 2, each seat 22 of the contacts of the poles defines a through channel and comprises a first hole 24 with a rectangular section which extends into the top part 20 of the body 2 and a second hole with a circular section 25 which extends into the bottom part 21 of the body 2. The second hole 25 is smaller than the first hole 24 so as to define a radial abutment surface 26. A step-like surface 27 is formed in the first hole, coinciding with the radial abutment surface 26.

Returning to FIG. 1, the seat 23 of the earth contact is substantially similar to the seats of the pole contacts. The only difference is represented by the fact that the seat 23 of the earth contact comprises a slot 28, which communicates with a recessed seat 29 formed in the outer surface of a side wall of the top part 20 of the body 2.

Respective recessed seats 30 within which respective tapered protrusions 31 ending in respective abutment surfaces 32 are formed in the other two opposite side walls of the top part 20 of the body 2. The recessed seat 30 has a substantially rectangular profile and is open at the bottom through a slot 33.

Respective holes 34 disposed in register with the protrusions 31 of the recessed seats 30 are formed in the top edge of the body 2.

The seats 22 of the body 2 have been designed to accommodate female contacts 4. As also shown in FIG. 2, the contact 4 consists of a substantially cylindrical body comprising a top portion 40 and a bottom portion 41 with a smaller diameter so as to give rise to a radial abutment surface 42.

An upwardly and laterally open first seat 43, adapted to receive a conductor 50 of an electrical feed cable, is formed in the top portion 40 of the contact. The conductor 50, for example, is crimped to the wires of the electrical feed cable 5 and has a tapered collar 51 of insulating material.

In the top end of the contact 4 there is provided a tooth 44 having a sloping end, so that in the top portion 40 of the contact there is formed a second seat 45, defined by a substantially C-shaped profile, adapted to accommodate a spring 7. The second seat 45 is disposed on the opposite side with respect to the first seat 43.

The spring 7 takes the form of a metal plate bent substantially into a right-angled triangle. In a cathetus 70 of the spring there is formed a hole 71 in which the end 72' of another cathetus can be engaged. For this purpose the end 72' of the cathetus 72 is smaller in width to be able to enter the hole 71.

The spring 7 is housed in the second seat 45 of the contact 4, so that the top tooth 44 of the contact engages in the hole 71 of the spring, the cathetus 72 of the spring abuts against the wall of the second seat 45 and the top end 72' of the cathetus of the spring is situated beneath the sloping part of the tooth 44. In this situation the end 70' of the first cathetus of the spring protrudes partially into the upper part of the first seat 43 of the contact.

As has been stated, the contact 4 is a female contact, therefore the bottom part 41 thereof is hollow on the inside and has a downwardly open seat 46 to receive a male contact. As shown in FIG. 1 longitudinal notches 47 are formed in the bottom part 41 of the contact to elastically widen the bottom part 41 of the female contact when a male contact is coupled therein.

The earth contact 6 has a bottom part 41 like that of the pole contacts 4 and a flattened top part 60 wherefrom a tooth 44 like that of the pole contacts 4 protrudes upward to accommodate a spring 7 like that of the pole contacts 4.

A rectangular plate 61 provided with a threaded hole 62 adapted to receive a clamping screw 63 with a washer 64 to clamp the connector to the case of the connector element protrudes laterally from the flattened top part 60 of the earth contact 6.

The connector element 1 comprises a cover 8, which couples with the body 2 to close the contacts 4 and 6 inside the body 2. The cover 8 comprises a substantially square plate 80 wherein are formed three peripheral square holes 81 and a circular one 82 near the four corners. Near the peripheral square holes 81 there are respective circular holes 83 and near the circular peripheral hole 82 there is a respective square hole 84.

The circular holes 83, 82 are designed to allow the passage of conductors 50 connected to the respective feed (5) and earth cables, so that the insulating collar 51 of the conductor 50 engages inside the respective circular hole. The square holes 81, 84 are designed to allow the passage of the tip of a tool, such as a screwdriver, able to act on the respective spring 7 to prepare it for insertion or release of the conductor 50 of the electrical cable 5.

The circular holes 83, 82 are formed in respective parallelepiped seats 85, 86 adapted to be housed inside the seats 22, 23 of the body 2. A rectangular partition 87 adapted to slide in the seat 29 of the body 2 to abut against the plate 61 of the earth contact is provided in one side of the cover 8.

Two U-shaped tongues 88 giving raise to a bottom abutment surface 89 are provided in two opposite sides of the cover 8. The U-shaped tongues 88 slide in the respective recessed seats 30 of the body 2 so that the tapered protrusions 31 engage therein and the bottom abutment surface 32 of the tapered protrusions 30 abuts against the bottom protrusion 89 of the tongues 88 retaining the cover 8 on the body 2.

Furthermore, as shown in FIG. 2, behind each U-shaped tongue 88 there is provided a centring pin 90 adapted to friction engaging in the respective hole 34 in the top edge of the body 2.

Figure 3:
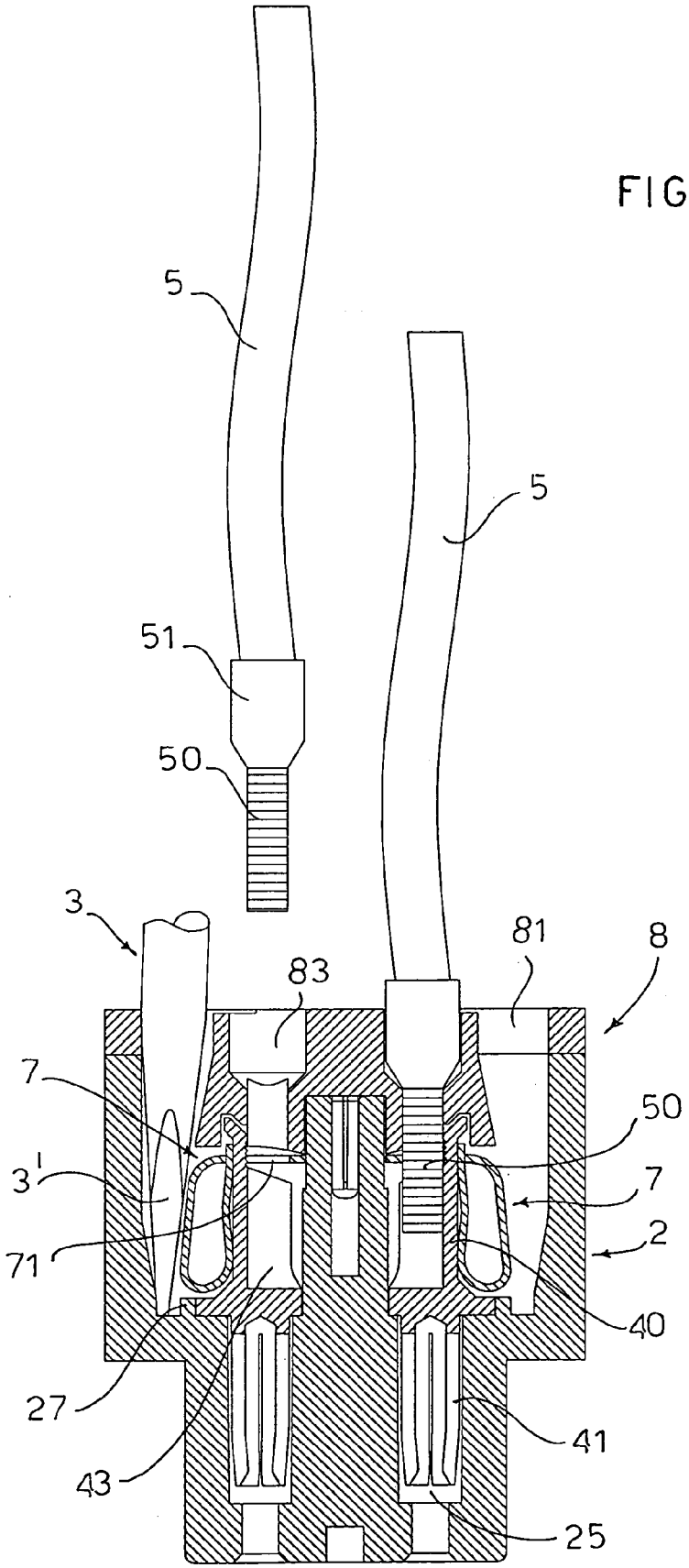
FIG. 3 is a partially axial sectional view illustrating the connector element of FIG. 2 assembled.

Assembly and wiring of the connector element 1 is described hereunder also with reference to FIG. 3.

Initially the three pole contacts 4 and the earth contact 6 with the respective springs 7 assembled are inserted from the top into the respective seats 22 and 23 of the body 2 so that the abutment surface 42 of each contact abuts against the abutment surface 26 of the respective seat. In this situation, the bottom part 41 of each contact is housed in the circular hole 25, whilst the top part 40, 60 with the respective spring 7 is housed in the rectangular hole 24 of the respective seat.

Once all the contacts 4, 6 have been inserted in the respective seats of the body 2, the cover 8 is mounted on the body 2, making the centring pins 90 engage in the respective holes 34 of the top edge of the body 2 and the tapered protruding parts 31 of the walls of the body 2 engage in the U-shaped tongues 88 of the cover 8.

When the cover 8 is assembled on the body 2, the circular holes 83 of the cover 8 are in register with the seats 43 of the contacts 4, the circular hole 82 of the cover is situated behind the flattened top part 60 of the earth contact 6 and all the square holes 81, 84 of the cover 8 are in register with the top cathetus 70 of the respective spring 7.

At this point wiring can be performed. The blade of a screwdriver is thus inserted into the hole 81, acting as a wedge by being inserted between the hypotenuse of the spring and the adjacent part of the hole. In this manner the spring 7 is compressed and the window 71 of the top cathetus 70 of the spring comes to be disposed beneath the hole 83.

At this point it is possible to insert the conductor 50 through the hole 83 and the window 71 of the spring. Finally, the blade of the screwdriver is removed, allowing the wall of the window 71 of the spring to press the conductor 50 against the seat 43 of the contact 50, thus keeping it clamped.

When the connector element 1 is to be rewired, the blade of the screwdriver is inserted into the square hole 81 of the cover so as to squeeze the top cathetus 70 of the spring 7 again near its rounded corner. In this manner compression of the spring 7 is caused and thus slackening of its pressure on the conductor of the body 2, with the result that the conductor 50 is free to be able to be removed from its seat.

Hereunder like or corresponding elements to those described are denoted with the same reference numerals and a detailed description thereof is therefore omitted.

Figure 4:
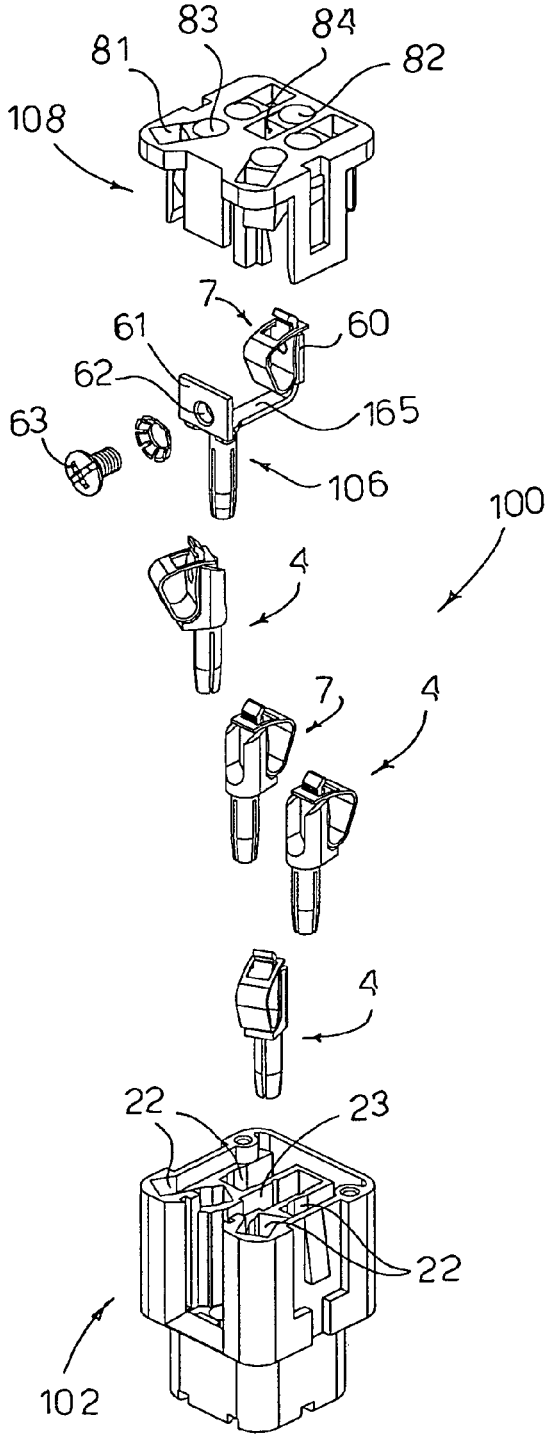
FIG. 4 is an exploded view illustrating a second embodiment of a connector element with four female pole contacts and an earth contact.

FIG. 4 shows a connector element 100 according to a second embodiment having four female pole contacts 4 like those of the first embodiment and a female earth contact 106 slightly different from the earth contact 6 of the first embodiment. In fact the earth contact 106 has an elongated connecting plate 162, which connects the plate 61 with the threaded hole 62 to the plate 60 of the support of the spring 7.

In this case, the body 102 is slightly modified having four seats 22 for the pole contacts, disposed near the four corners of the body and an elongated central seat 23 for the earth contact. Consequently the cover 108 too is modified, having four pairs of square and circular holes 81, 83 destined to be in register with the four seats of the pole contacts and a pair of square and circular holes 82, 84 destined to be disposed in register with the central elongated seat 23 of the earth contact.

FIG. 5 shows a connector element 200 having three male pole contacts 204 and a male earth contact 206. The male contacts 204 and 206 are like the contacts 4 and 6 of the first embodiment of the female connector element 1, except for the bottom part 246 of the contact which has a full cylindrical shape adapted to engage inside the hollow bottom part 46 of the female contacts 4 and 6.

In this case, the bottom part 221 of the body 202 is slightly modified. In fact the bottom part 221 of the body 202 is hollow on the inside and downwardly open to receive the bottom part 21 of the body 2 of the female connector element 1 in a coupling relationship. A square gasket 9 is provided which is disposed between the two bottom parts 21 and 221 of the two bodies 2, 202 to provide a seal between them.

The cover 8 of the connector element 200 is the same as that of the connector element 1.

Figure 6:
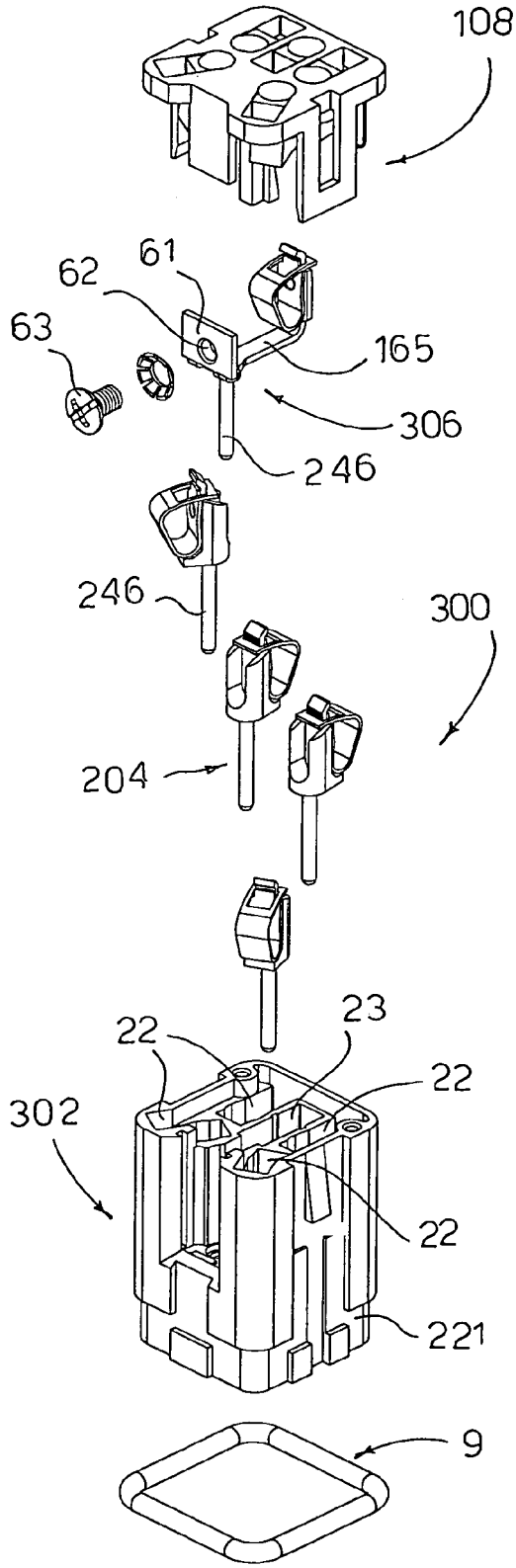
FIG. 6 is an exploded view like FIG. 4 of a connector element with four male pole contacts and an earth contact.

FIG. 6 illustrates a connector element 300 having four male pole contacts 204 like those of the connector element 200 and a male earth contact 306 like the earth contact 106 of the connector element 100 of the second embodiment, but having a male bottom part 246.

In this case, the body 302 has a top part like that of the body 102 of the connector element 100, comprising four seats 22 for the pole contacts, disposed near the four corners of the body 302, a central elongated seat 23 for the earth contact and a bottom part 221 like that of the connector element 200. The cover 108 of the connector element 300 is like that of the connector element 100 of the second embodiment.

In all the connector elements illustrated, the springs 7 are made of conductive metal material and are disposed in the respective seats 22 and 23 of the bodies 2, 102, 202 and 302, completely insulated from the outside. In fact the bodies 2, 102, 202 and 302 are made of insulating plastic material and its walls are of such a thickness as to allow adequate insulation of both the springs 7 and the contacts 4, 6, 204 and 206. In this manner the connector elements 1, 100, 200 and 300 can be used to make an electrical connector that can be used with rated voltages greater than 250 V up to 400 V.

Numerous changes and modifications of detail within the reach of a person skilled in the art can be made to the present embodiments of the invention without thereby departing from the scope of the invention as set forth in the appended claims.

The invention claimed is:

1. An electrical connector element (1; 100; 200; 300), adapted to couple with a complementary electrical connector element, said electrical connector element comprising:

a body of insulating material (2; 102; 202; 302) inside which are formed first seats (22) housing respective first metal contacts (4; 204) adapted to receive respective conductors (50) of electrical feed cables, and a second seat (23) housing a second metal contact (6; 106; 206; 306) adapted to come into contact with a conductor of an electrical earth cable, said second metal contact (6; 106; 206; 306) comprising a plate (61) provided with a threaded hole (62) able to accommodate a screw (63);

a cover (8; 108) which can be coupled on said body and provided with first holes (83, 82) disposed in registration with said first and second contacts to allow insertion of the conductors of the feed and earth cables; and spring clamping means (7) of metal material disposed in said first and second seats (22, 23) to clamp the electrical cable conductors in contact with the respective first and second contacts, the whole so that said first and second metal contacts and said spring clamping means remain protected inside said insulating body.

2. A connector element according to claim 1, wherein said first metal contact (4; 204) comprises a first seat adapted to house said conductor (50) of the electrical cable (5) and a second seat (43) adapted to house said spring means (7).

3. A connector element according to claim 1, wherein said spring means (7) comprises a metal plate bent to form a triangle.

4. A connector element according to claim 1, wherein said cover (8, 108) comprises second holes (81, 84) disposed in registration with said spring means (7) to allow insertion of a tool able to act against said spring means (7) to prepare them for engagement and disengagement of the conductor (50) of the electrical cable.

5. A connector element according to claim 1, comprising three of said first metal contacts (4; 204) and wherein said first and second seats are disposed along the diagonals of the body.

6. A connector element according to claim 1, comprising four of said first metal contacts (4; 204) and wherein said first and second seats are disposed near the corners of the body and said second seat (23) of the earth contact is disposed in a central position.

7. An electrical connector comprising a male connector element and a female connector element according to claim 1.

8. A connector element according to claim 3, wherein said plate of the spring (7) takes the form of a right-angled triangle, in which one cathetus (70) has a further hole (71) adapted to receive the end (72') of another cathetus (72).

9. A connector element according to claim 8, wherein said first metal contact comprises a tooth (44) adapted to engage in said further hole (71).

10. A connector element according to claim 4, wherein said first holes are circular and said second holes are square.

11. An electrical connector element (1; 100; 200; 300), adapted to couple with a complementary electrical connector element, said electrical connector element comprising:

a body of insulating material (2; 102; 202; 302) inside which are formed first seats (22) housing respective first metal contacts (4; 204) adapted to receive respective conductors (50) of electrical feed cables, and a second seat (23) housing a second metal contact (6; 106; 206; 306) adapted to come into contact with a conductor of an electrical earth cable, a cover (8; 108) which can be coupled on said body and provided with first holes (83, 82) disposed in registration with said first and second contacts to allow insertion of the conductors of the feed and earth cables, and spring clamping means (7) of metal material disposed in said first and second seats (22, 23) to clamp the electrical cable conductors in contact with the respective first and second contacts, the whole so that said first and second metal contacts and said spring clamping means remain protected inside said insulating body, wherein said first and second seats (22, 23) of the body comprise a rectangular hole (22) adapted to receive the top part of the contact with the respective spring means (7) and a circular hole (25) adapted to receive the bottom part (46; 246) of the contact, destined to couple with the bottom part of a contact of a complementary connector element.

12. A connector element according to claim 11, wherein said first metal contact (4; 204) comprises a first seat adapted to house said conductor (50) of the electrical cable (5) and a second seat (43) adapted to house said spring means (7).

13. A connector element according to claim 11, wherein said spring means (7) comprises a metal plate bent to form a triangle.

14. A connector element according to claim 11, wherein said cover (8, 108) comprises second holes (81, 84) disposed in registration with said spring means (7) to allow insertion of a tool able to act against said spring means (7) to prepare them for engagement and disengagement of the conductor (50) of the electrical cable.

15. A connector element according to claim 11, comprising three of said first metal contacts (4; 204) and wherein said first and second seats are disposed along the diagonals of the body.

16. A connector element according to claim 11, comprising four of said first metal contacts (4; 204) and wherein said first and second seats are disposed near the corners of the body and said second seat (23) of the earth contact is disposed in a central position.

17. An electrical connector comprising a male connector element and a female connector element according to claim 11.

18. A connector element according to claim 13, wherein said plate of the spring (7) takes the form of a right-angled triangle, in which one cathetus (70) has a further hole (71) adapted to receive the end (72') of another cathetus (72).

19. A connector element according to claim 18, wherein said first metal contact comprises a tooth (44) adapted to engage in said further hole (71).

20. A connector element according to claim 14, wherein said first holes are circular and said second holes are square.

* * * * *